US009692158B1

(12) United States Patent
Vinther et al.

(10) Patent No.: US 9,692,158 B1
(45) Date of Patent: Jun. 27, 2017

(54) CONNECTOR ASSEMBLY FOR ATTACHING CABLES TO A PLANAR ELECTRICAL DEVICE

(71) Applicant: Ardent Concepts, Inc., Seabrook, NH (US)

(72) Inventors: Gordon A Vinther, Seabrook, NH (US); Sergio Diaz, Cambridge, MA (US)

(73) Assignee: Ardent Concepts, Inc., Hampton, NH (US)

( * ) Notice: Subject to any disclaimer, the term of this patent is extended or adjusted under 35 U.S.C. 154(b) by 0 days.

(21) Appl. No.: 15/156,238

(22) Filed: May 16, 2016

Related U.S. Application Data

(60) Provisional application No. 62/162,149, filed on May 15, 2015.

(51) Int. Cl.
*H01R 13/627* (2006.01)
*H01R 12/70* (2011.01)

(52) U.S. Cl.
CPC ..... *H01R 12/7058* (2013.01); *H01R 12/7029* (2013.01); *H01R 13/6275* (2013.01)

(58) Field of Classification Search
CPC ..... H01R 13/627; H01R 13/6271; H01R 13/6272; H01R 13/6273; H01R 13/6275; H01R 13/6335
USPC ..... 439/355, 358, 923
See application file for complete search history.

(56) References Cited

U.S. PATENT DOCUMENTS 5,154,629 A * 10/1992 Carver ..... G02B 6/3817 439/352
5,197,900 A * 3/1993 Ellis ..... H01R 13/6275 439/350
6,113,415 A * 9/2000 Bertsch ..... H01R 13/514 439/353
6,146,210 A * 11/2000 Cha ..... H01R 13/2421 439/289
6,663,412 B2 * 12/2003 Aramoto ..... H01R 13/6273 439/357
7,001,200 B2 * 2/2006 Yoshie ..... G06F 1/1632 439/358
7,040,910 B2 * 5/2006 Nagata ..... H01R 13/6273 439/352

(Continued)

*Primary Examiner* — Hae Moon Hyeon
(74) *Attorney, Agent, or Firm* — Altman & Martin; Steven K Martin

(57) ABSTRACT

A connector assembly for connecting cables to a planar electrical device that has a compression mount connector. In one embodiment, the connector reciprocates within a shroud and is spring-biased outwardly. A pair of latches are pivotally mounted to the shroud. In a second embodiment, the connector has compliant contacts and the latches are pivotally mounted to the connector. In a third embodiment, the latches are spring-mounted to the connector. Each latch has an arm that extends beyond the connector face. A hook at the end of the arm curves through an angle of greater than 90°. The hook face is offset from the edge of the planar electrical device and aligned with the connector face. When the connector assembly is connected to the planar electrical device, the connector spring bias pulls the hook faces against the planar electrical device to securely pull the connector face to the planar electrical device.

6 Claims, 8 Drawing Sheets

(56) References Cited

U.S. PATENT DOCUMENTS

| | | | | |
|---|---|---|---|---|
| 7,484,989 | B2 * | 2/2009 | Venaleck | H01R 13/6275 439/352 |
| 8,449,314 | B1 * | 5/2013 | Feist | H01R 13/6275 439/358 |
| 8,961,217 | B2 * | 2/2015 | Dang | H01R 13/6275 439/358 |
| 2015/0125118 | A1 * | 5/2015 | Droesbeke | G02B 6/4269 385/78 |

* cited by examiner

CONNECTOR ASSEMBLY FOR ATTACHING CABLES TO A PLANAR ELECTRICAL DEVICE

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to electrical cable attachments to circuit boards and other planar electrical devices, more particularly, to terminating multiple compliant interconnects to a planar electrical device with the mating pressure needed to make a good connection to all termination points without imparting a moment force on the planar electrical device which could cause the planar electrical device to bend or bow under the force of the connector.

2. Description of the Related Art

One purpose of a cable termination is to provide a separable electrical interconnection between a cable and a PCB or other planar electrical device. The characteristic of separability means that the cables are not interconnected by permanent mechanical means, such as soldering or bonding, but by temporary mechanical means.

One form of prior art is a system which uses two independent parts to mate several cables to its electrical environment. This system uses one part that is generally soldered to a printed circuit board and another part that is generally mated to several cables. The two pieces can be plugged together to form the interconnection. These systems provide better-controlled impedance environments but are limited in the densities at which the cables can be used. That is, the cables require a minimum space between them to achieve the controlled impedance environment and thus only a small number of cables can be terminated in a given area.

For compliant interconnects, the standard method of securing compliant connectors is with jack screws or rivets or some other mechanical means which passes through the connector and applies the appropriate Z-axis force to properly mate the compliant connects to their mating surface on the PCB or other electrical device.

Another form of prior art is a system which employs removable cables that are held to the device by means of a spring. The cable has a terminal end which makes the signal conductor extend from the cable terminal end. The terminal is then pressed to the device by means of a spring and the ground shield of the cable is connected to the device by a conductive rubber ground shield which shorts the terminal ground to the device ground.

BRIEF SUMMARY OF THE INVENTION

The present invention is a connector assembly for connecting cables to a planar electrical device such as a printed circuit board (PCB). In one embodiment, the connector assembly has a compression-mount connector mounted in a shroud. The connector has a generally flat face and extends through a shroud connector opening so that that the face abuts the PCB when attached. In order to accommodate PCBs of various thicknesses, the connector is mounted in the shroud so that can be pushed into the shroud during attachment but is spring-biased outwardly to make a robust electrical connection with the PCB.

A latch on both sides of the shroud secure the termination assembly to the PCB. Each latch has a hub with a lever extending in one direction and an arm extending in the opposite direction to a hook. The latch hub is pivotally attached in a cavity in the shroud by a pin through axially-aligned holes in the cavity walls and the hub. A coil torsion spring biases the latch to a closed position, where the latch hooks are pressing inwardly toward the connector. Pushing the lever into the cavity causes the hook to pivot away from the connector into an open position.

Optionally, each latch has a lock that prevents the latch from unlatching inadvertently. A button is attached to the end of the lever to reciprocate longitudinally between a lock position and an unlock position. A coil spring biases the button to the lock position and pushing the button puts it into the unlock position. A tab at the end of the button fits in a notch at the end of the cavity when in the lock position. The back wall of the notch stops the tab from moving into the cavity. When in the unlock position, the tab clears the notch back wall and can be pushed onto the cavity.

In a second embodiment, the connector has compliant contacts and the latches are pivotally attached to the connector.

In a third embodiment, the latches are spring-mounted to the connector.

The latch hook is formed by curving the arm end through an angle of more than 90°. The end of the hook has a flattened face that is generally parallel to the connector face when the latch is in the closed position. The hook face is offset from the inner edge of the arm so that it is aligned with the connector face. The hook face reaches past the edge of the PCB to impart its force on the PCB at an offset from the PCB edge so that it is away from the edge of the PCB.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
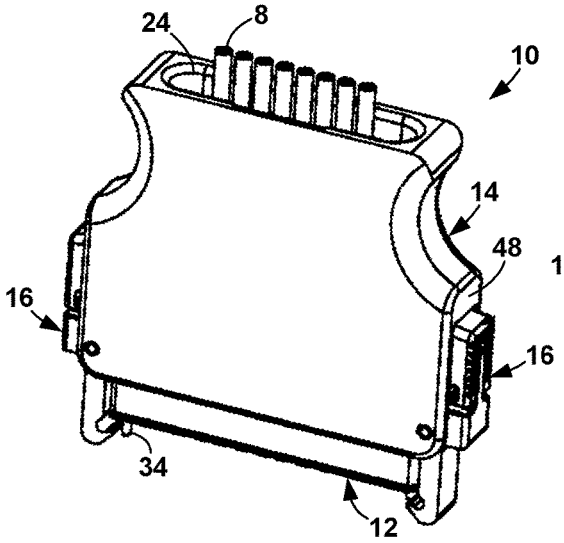
FIG. 1 is an isometric view of the first embodiment of the connector assembly of the present invention.
Figure 2:
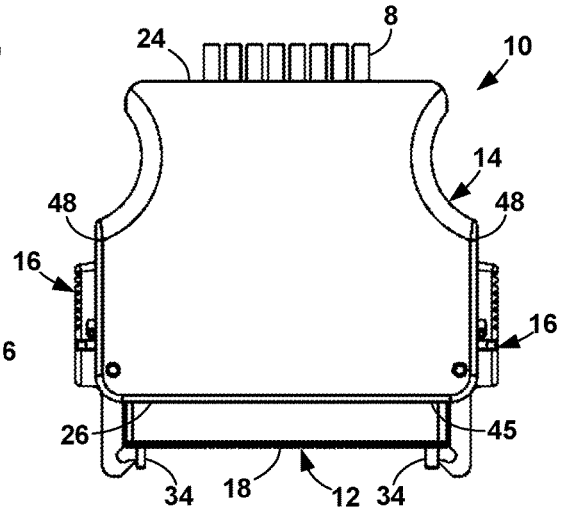
FIG. 2 is a front view of the connector assembly of FIG. 1.
Figure 3:
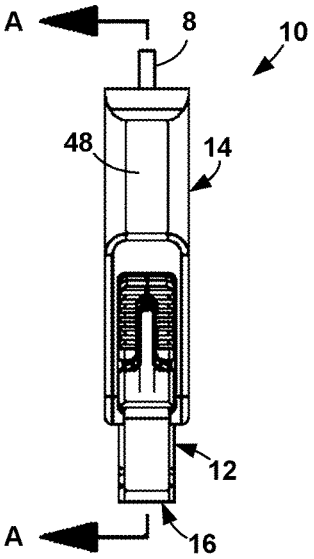
FIG. 3 is a side view of the connector assembly of FIG. 1.

The present application hereby incorporates by reference in its entirety U.S. Provisional Patent Application No. 62/162,149, on which this application is based.

The present invention is an apparatus for terminating one or more cables to a planar electrical device, such as a printed circuit board (PCB), without screws or other latching hardware that cannot be removed without using tools. The term, PCB, in the remainder of the present specification and claims is intended to include all planar electrical devices to which the termination of the present invention can connect. The connector assembly 10 of the present invention also does not require extra connectors to be soldered to the PCB before connectors can be mated. The connector assembly 10 requires only holes in the PCB to receive latches and optional alignment pins. The connector assembly 10 also provides a secure connection to the PCB for all typical thicknesses of PCB. The connector assembly 10 imparts enough Z-axis force 17 on the PCB to maintain a stable and repeatable interconnect without imparting moment forces which can bend or warp the PCB.

As shown in FIGS. 1-5, the first embodiment of the connector assembly 10 of the present invention includes a compression-mount connector 12 mounted in a shroud 14 and two latches 16, one on either side of the shroud 14, that hold the connector assembly 10 securely to the PCB 2. The shroud 14 has a cable opening 24 for cables 8, a connector opening 26 opposite the cable opening 24, and sides 48 extending between the cable opening 24 and connector opening 26. The present specification describes the shroud 14 as an enclosed device, what is typically called a shroud in the art. The present invention, however, does not require a typical shroud but only requires that the shroud 14 be able to perform as described below. The shroud 14 can be fully enclosed, merely a frame that is fully open, or something in between.

The connector 12 has a face 18 that is generally flat and extends through the shroud connector opening 26 so that that the face 18 abuts the PCB 2 when the connector assembly 10 is attached to the PCB 2. Optionally, one or more alignment pins 34 extend from the face 18.

Figure 4:
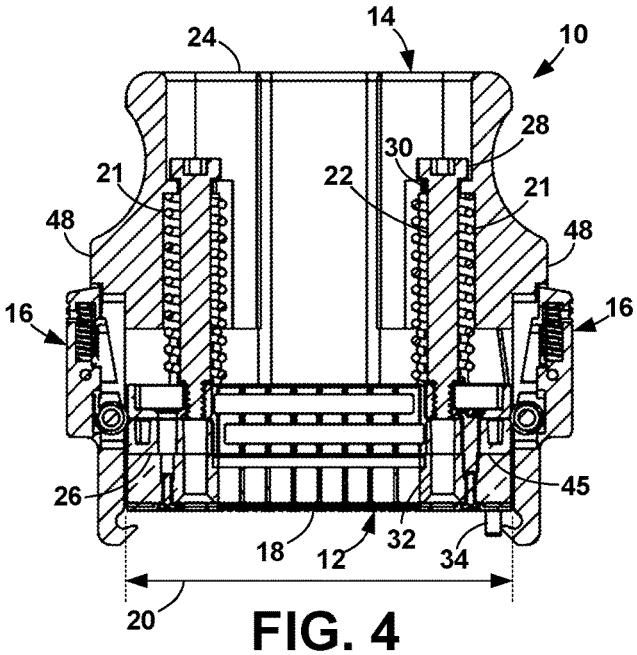
FIG. 4 is a cross-section of the connector assembly of FIG. 1 taken at A-A of FIG. 3.
Figure 5:
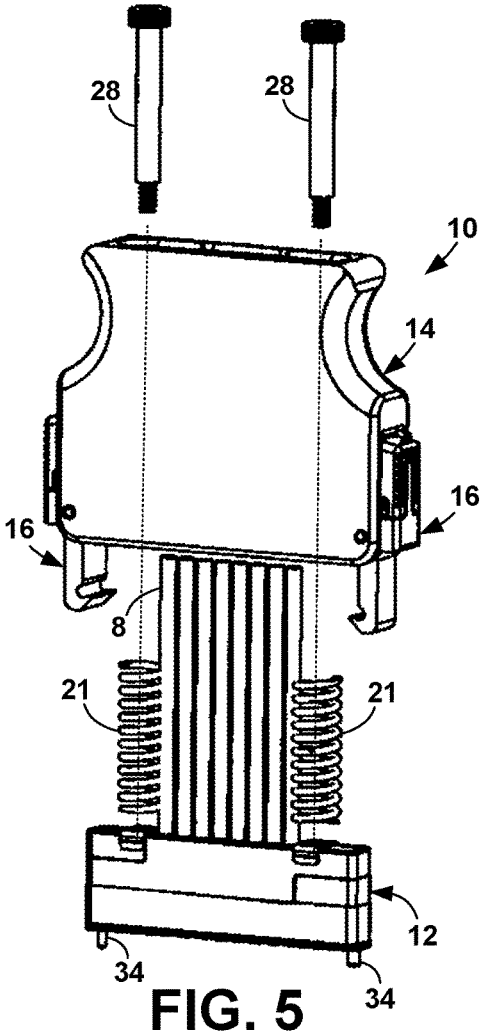
FIG. 5 is a partially exploded view of the connector assembly of FIG. 1.
Figure 7:
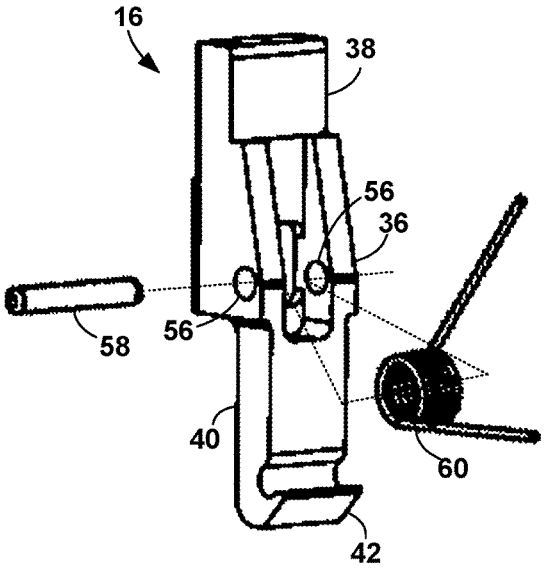
FIG. 7 is an exploded view of the latch of FIG. 1 without the lock.
Figure 6:
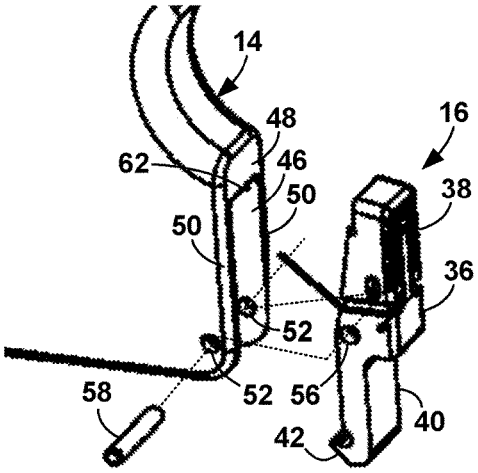
FIG. 6 is an exploded view of the shroud of FIG. 1.

As indicated above, the connector assembly 10 is designed to accommodate PCBs of various thicknesses. To that end, the connector 12 is mounted in the shroud 14 so that it reciprocates in the connector opening 26. The connector 12 can be pushed into the shroud 14 during attachment to a PCB 2 but is biased outwardly by a pair of coil springs 21 inside the shroud 14, as can be seen in FIGS. 4 and 5. The coil springs 21 are secured by a pair of screws 28 that hold the connector assembly 10 together. The screws 28 extend through holes 30 in the shroud 14, through the coil springs 21, and into threaded holes 32 in the connector 12. The shoulders 22 of the screws 28 slide through the holes 30 in the shroud 14 so that the connector 12 reciprocates in the connector opening 26. When the connector assembly 10 is mated to the PCB 2, the latches 16 lock onto the underside of the PCB 2 as described below, and the coil springs 21 supply the Z-axis force 17 required to make a robust electrical connection with the PCB 2.

Figure 9:
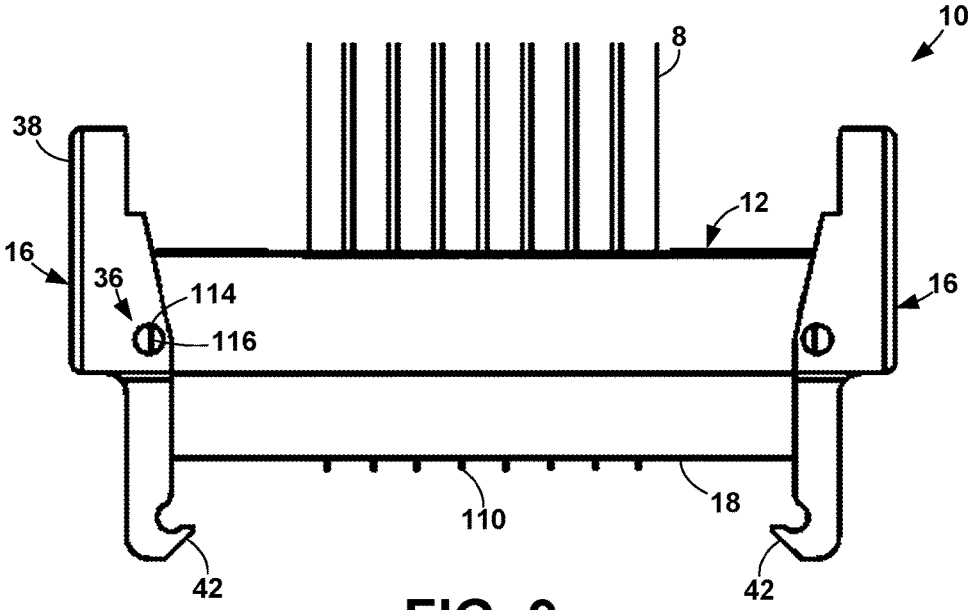
FIG. 9 is a front view of the second embodiment of the connector assembly of the present invention.
Figure 10:
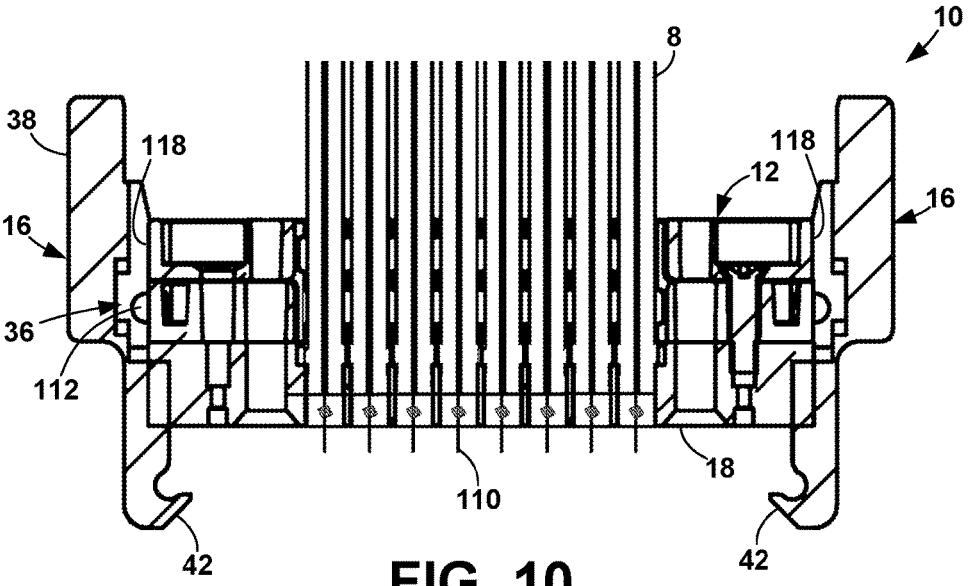
FIG. 10 is a cross-section of the connector assembly of FIG. 9.

A second embodiment of the connector assembly 10 of the present invention is shown in FIGS. 9 and 10. Rather than the latches 16 being mounted to a shroud 14 and using coil springs 21 to provide the outward bias, the latches 16 are mounted directly to the connector 12 and the outward bias is provided by compliant contacts 110 extending from the face 18 of the connector 12. Optionally, if a stronger bias is desired, spring-loaded plates can be used on each end of the connector face 18 to push against the PCB 2.

Figure 11:
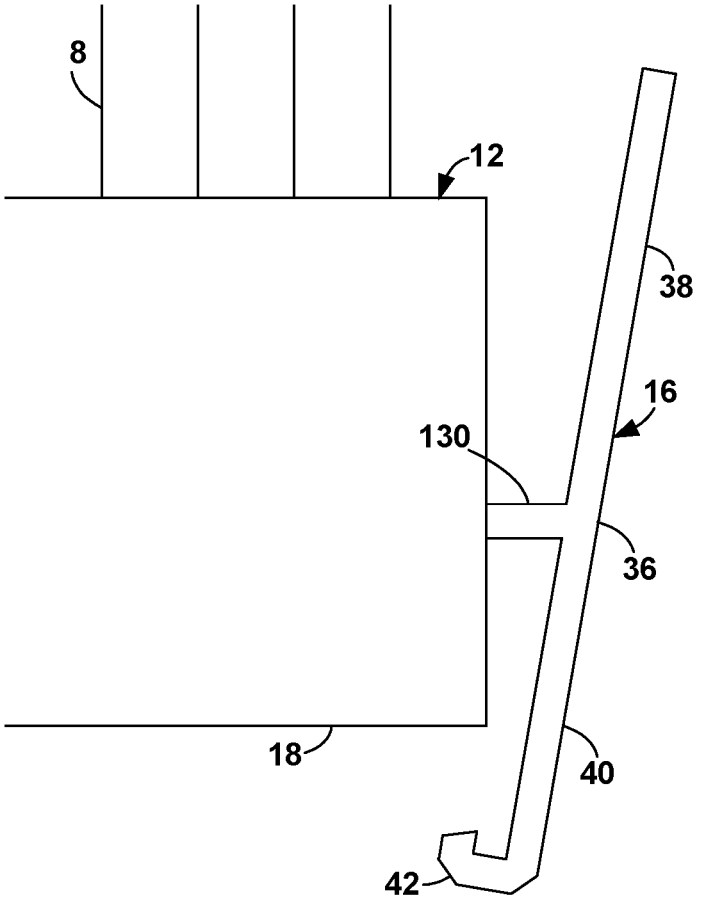
FIG. 11 is a front view of the second embodiment of the connector assembly of the present invention.

A third embodiment of the connector assembly 10 of the present invention is shown in FIG. 11. Like the second embodiment, the latches 16 are mounted directly to the connector 12. However, rather than using compliant contacts to provide the outward bias, the latch attachment leg 130 provides the bias, as described below.

Each latch 16 has a hub 36 with a lever 38 extending from the hub 36 in one direction and an arm 40 extending from the hub 36 in generally the opposite direction from the lever 38.

In the first embodiment, the latch 16 pivotally attaches to the shroud 14. Each latch 16 fits into a cavity 46 in the end 45 of the shroud 14. The walls 50 of the cavity 46 have a pair of axially-aligned shroud holes 52. The latch hub 36 has a pair of axially-aligned pivot holes 56. When the latch 16 is installed in the cavity 46, the shroud holes 52 and pivot holes 56 are aligned and receive a pivot pin 58 that is press-fit into either the shroud holes 52 or the pivot holes 56. The latch 16 pivots on the pin 58.

A coil torsion spring 60 mounted on the pin 58 biases the latch 16 to the closed position. In the closed position, the latch hooks 42 are pressing inwardly toward the connector 12. The back wall 54 of the cavity 46 acts as a stop for the latch 16. Pushing the lever 38 into the cavity 46 causes the hook 42 to pivot away from the connector 12 into the open position. When pressure is released from the lever 38, the spring 60 returns the latch 16 to the closed position.

Figure 8:
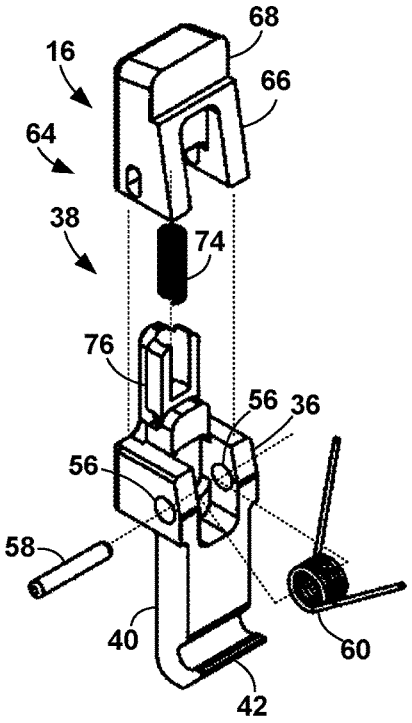
FIG. 8 is an exploded view of the latch of FIG. 1 with the lock.
Figure 12:
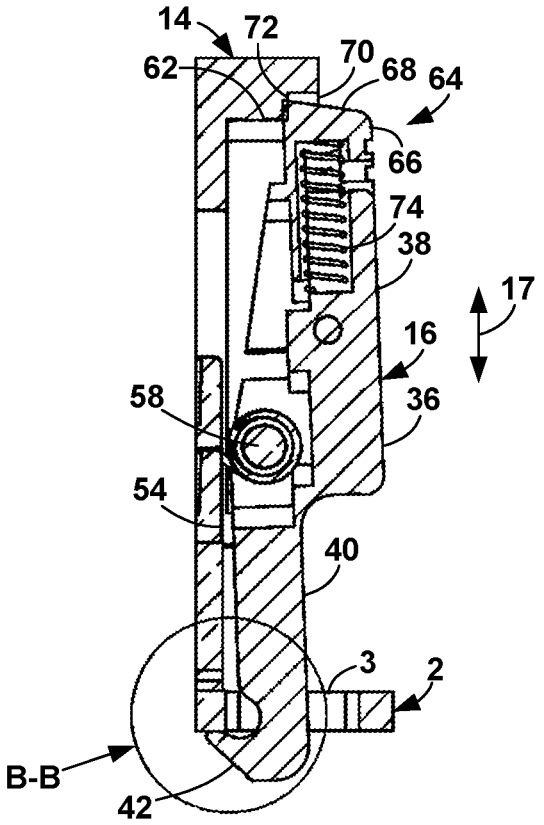
FIG. 12 is a cross-sectional view of the latch FIG. 1.

Optionally and as shown in FIGS. 8 and 12, each latch 16 has a lock 64. The lock 64 prevents the latch 16 from unlatching inadvertently by requiring a lock button 66 be depressed in order for the latch 16 to pivot and release the PCB 2. The lock button 66 is attached to the end of the lever 38 so that it reciprocates longitudinally on rails 76 on the lever 38 between a lock position and an unlock position. A coil spring 74 biases the lock button 66 away from the latch hub 36 to the lock position and pushing the lock button 66 toward the latch hub 36 moves the lock button 66 to the unlock position.

The lock button 66 has a tab 68 that fits in a notch 70 at the cable opening end 62 of the cavity 46 when in the lock position. The back wall 72 of the notch stops the tab 68 from moving into the cavity 46 if the lever 38 is pushed inwardly. When the lock button 66 is pressed to the unlock position, the tab 68 clears the notch back wall 72 and can move into the cavity 46 when the lever 38 is pushed inwardly. The pivot pin 58 acts as a stop for the lock button 66 so that the lock button 66 cannot be pressed too far.

In the second embodiment, the latch 16 pivotally attaches to the connector 12. Similarly to the first embodiment, the connector 12 has a connector hole 112 and the latch hub 36 has a pair of axially-aligned pivot holes 114. When the latch 16 is installed on the connector 12, the connector hole 112 and pivot holes 114 are aligned and receive a pivot pin 116 that is press-fit into either the connector hole 112 or the pivot holes 114. The latch 16 pivots on the pin 116.

As with the first embodiment, a coil torsion spring (not shown) mounted on the pin 116 biases the latch 16 to the closed position. The wall 118 of the connector 12 acts as a stop for the latch 16. Pushing the lever 38 to the connector 12 causes the hook 42 to pivot away from the connector 12 into the open position. When pressure is released from the lever 38, the spring returns the latch 16 to the closed position.

In the third embodiment, as described above, the latch 16 pivotally attaches to the connector 12 by a compliant latch attachment leg 130 between the connector 12 and the hub 36. The latch attachment leg 130 can flex up and down.

Figure 13:
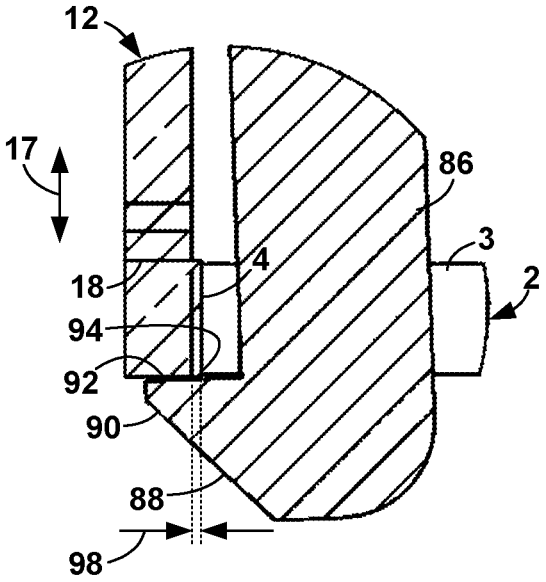
FIG. 13 Prior Art
FIG. 13 is a detailed, cross-sectional view of the end of a prior art arm.

The essence of the present invention is that the force exerted on the PCB 2 by the latch 16 is aligned with the connector face 18. This alignment helps to improve signal quality through the connector 12. In latches of the prior art, such as in FIG. 13, the end of the arm 86 is bent to a finger 88 at a 90° angle. The flat face 92 of the finger 88 catches on the edge 4 of the PCB aperture 3 when the arm 86 is pivoted a few degrees, as at 94, and puts the latch force at a distance 98 outside of the connector face 18 on the aperture edge 4. With the latch force not aligned with the connector face 18, that is, not directly under the connector face 18 in FIG. 13, a bending moment is imparted to the PCB 2, which can cause it to bend and bow, which may be detrimental to the signal quality through the connector 12.

Figure 14:
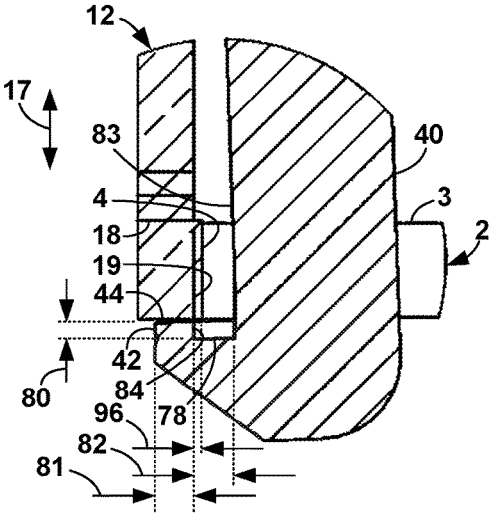
FIG. 14 is a detailed, cross-sectional view of a first embodiment of the arm end of FIG. 12 taken at B-B.
Figure 15:
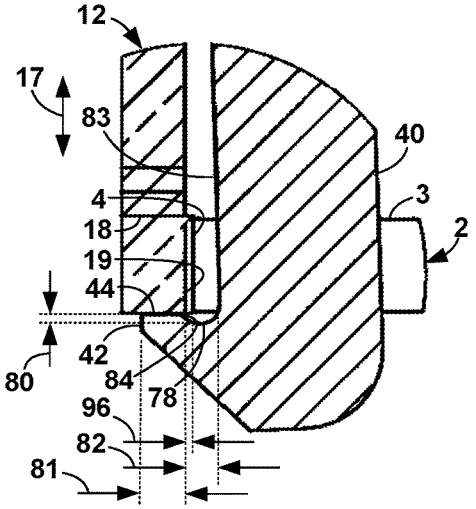
FIG. 15 is a detailed, cross-sectional view of a second embodiment of the arm end of FIG. 12 taken at B-B.
Figure 16:
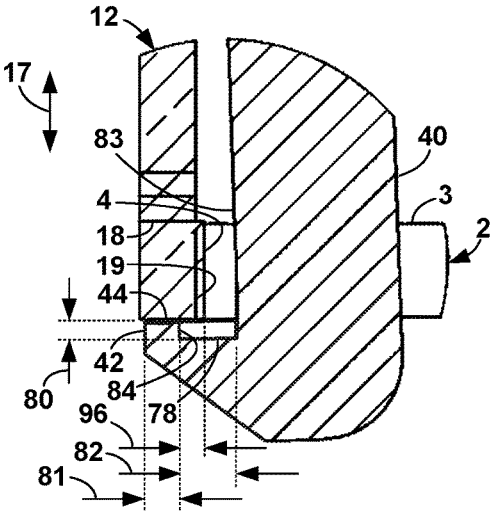
FIG. 16 is a detailed, cross-sectional view of a third embodiment of the arm end of FIG. 12 taken at B-B.
Figure 17:
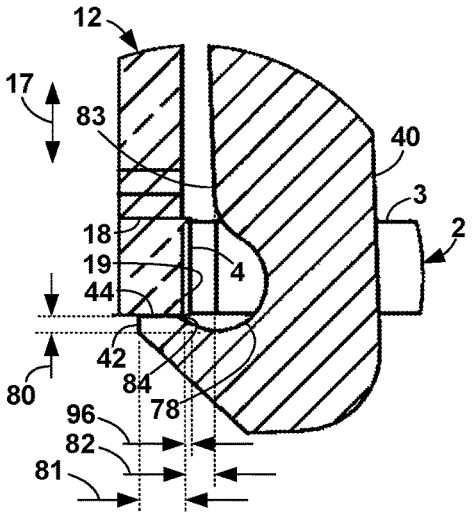
FIG. 17 is a detailed, cross-sectional view of a fourth embodiment of the arm end of FIG. 12 taken at B-B.

As indicated above, the force exerted on the PCB 2 by the latch 16 of the present invention is aligned with the connector face 18. To accomplish this, the end of the arm 40 has a curve 78 with an angle of more than 90°, as in FIGS. 14-17, to form a hook 42. The curve 78 can be any shape, such as rectangular in FIGS. 14 and 16 or rounded in FIGS. 15 and 17. Optionally, the curve 78 can be exaggerated, as in FIG. 17, to aid in clearance of the PCB 2 during connection to the PCB 2.

The end of the hook 42 has a hook face 44 that is flat and generally parallel to the connector face 18 when the latch 16 is in the closed position. The hook face 44 is at an offset 80 toward the connector face 18 from the 90° point of the curve 78 and at an offset 82 from the inner edge 83 of the arm 40. These offsets 80, 82 allow the hook face 44 to reach past the edge 4 of the PCB 2 to impart its force on the PCB 2 at an offset 96 from the PCB edge 4 so that the hook face 44 is aligned with the connector face 18 (under the connector face 18 in FIGS. 14-17) rather than at the edge 4 of the PCB 2.

For the present specification and claims, the hook face 44 is considered to be aligned with the connector face 18 if the entire width 81 of the hook face 44 is within the width 20 of the connector face 18. For example, in FIGS. 14, 15, and 17, the outer edge 84 of the hook face 44 is planar with the edge 19 of the connector face 18. In another example of FIG. 16, the outer edge 84 of the hook face 44 is farther inward than the edge 19 of the connector face 18.

The absolute lengths of the offsets 80, 82 depend on the particular application for the latch 16 of the present invention is being designed. The 90° point offset 80 can be minimal. It only needs to be large enough that no force is being exerted on the PCB 2 from that portion of the hook 42 between the arm inner edge 83 and the hook outer edge 84. The length of the hook to arm offset 82 must be large enough that the hook face 44 is aligned with the connector face 12. That offset 82 depends on how far the edge 4 of the PCB 2 is from where the connector face 18 makes contact with the PCB 2.

Figure 18:
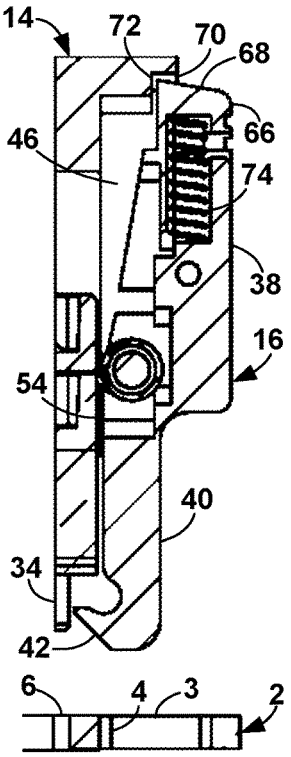
FIG. 18 is a cross-sectional view of the first embodiment with a PCB prior to connection.
Figure 19:
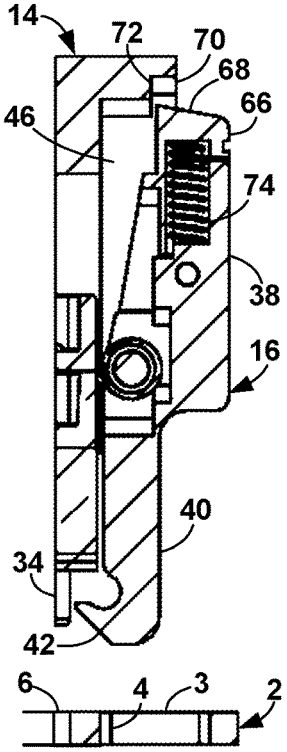
FIG. 19 is a cross-sectional view of the first embodiment with a PCB with the lock button pressed.
Figure 20:
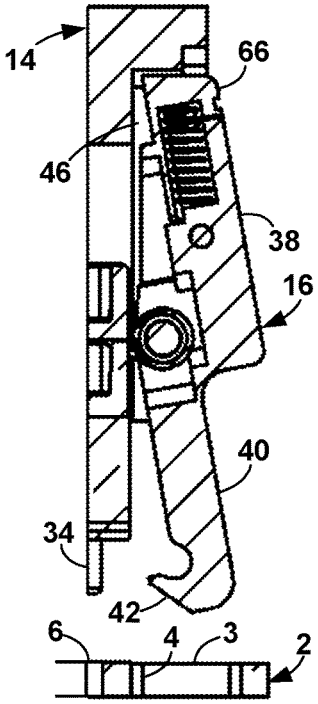
FIG. 20 is a cross-sectional view of the first embodiment with a PCB with the latch in the open position.
Figure 21:
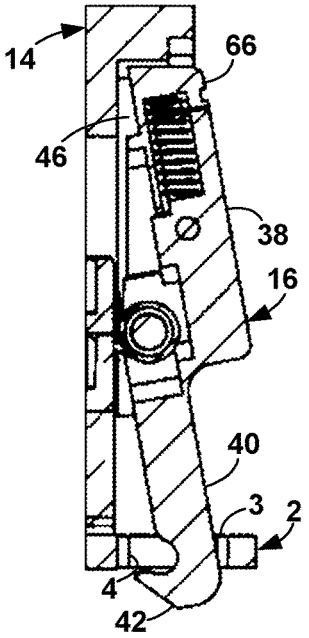
FIG. 21 is a cross-sectional view of the first embodiment in contact with the PCB.

FIGS. 18-21 and 9 show how the latch 16 of the first embodiment of the present invention operates. In FIG. 18, the latch 16 is in the fully closed position with the lock button 66 extended to the lock position, ready for the connector assembly 10 to be connected to the PCB 2. In FIG. 19, the lock button 66 is pressed to the unlock position so that it clears the back wall 72 of the notch 70. In FIG. 20, the latch 16 is pushed into that cavity 46 so that the arm 40 pivots outwardly. In FIG. 21, the connector assembly 10 is moved to make contact with the PCB 2. The shroud 14 is pushed towards the PCB 2 so that the connector 12 is forced into the shroud 14 against the coil springs 21 and the latch 16 goes through the PCB aperture 3. The optional alignment pins 34 fit into alignment holes 6 in the PCB 2. When the latch 16 is released, as in FIG. 12, the torsion spring 60 pivots the latch 16 back to the closed position so that the hook face 44 is aligned with the connector 12. The connector springs 21 push the connector 12 against the PCB 2 and the PCB 2 against the hook face 44 on the z-axis 17. As the lock button 66 clears the notch back wall 72, the lock spring 74 returns the lock button 66 to its lock position, preventing the latch 16 from inadvertently being detached from the PCB 2.

The latch 16 of the second embodiment works in essentially the same way as the latch 16 of the first embodiment.

Figure 22:
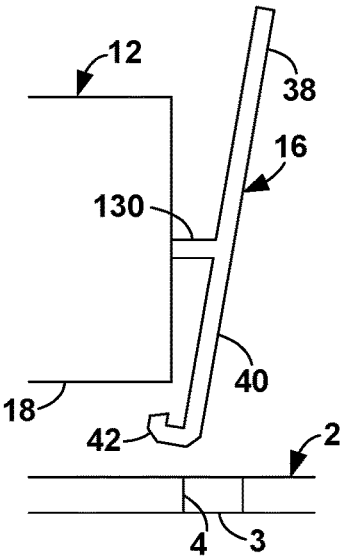
FIG. 22 is a cross-sectional view of the third embodiment with a PCB prior to connection.
Figure 23:
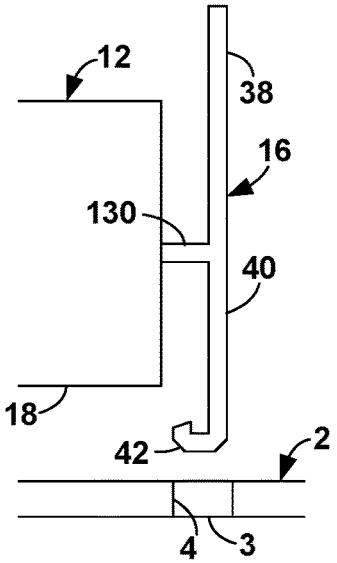
FIG. 23 is a cross-sectional view of the third embodiment with a PCB with the latch in the open position.
Figure 24:
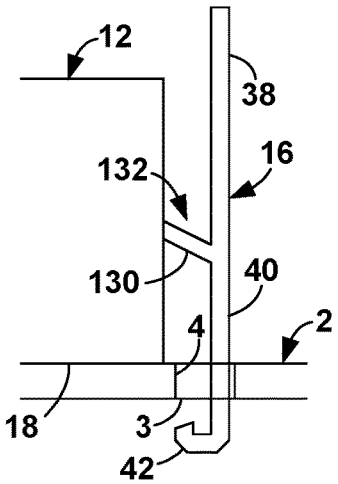
FIG. 24 is a cross-sectional view of the third embodiment with a PCB with the connector pressed against the PCB.
Figure 25:
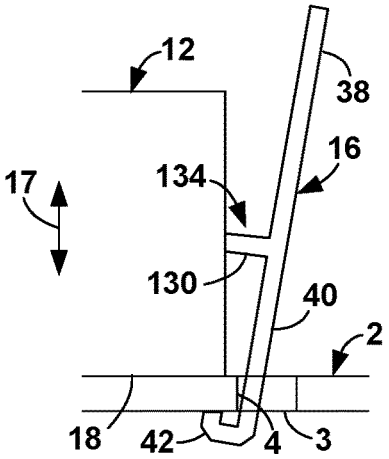
FIG. 25 is a cross-sectional view of the latch in contact with the PCB.

FIGS. 22-25 show how the latch 16 of the third embodiment of the present invention operates. In FIG. 22, the latches 16 are in the fully closed position, ready for the connector assembly 10 to be connected to the PCB 2. In FIG. 23, the levers 38 are manually pressed inwardly to move the arms 40 to the open position. In FIG. 24, the latches 16 are pushed downwardly through the PCB aperture 3 until the hooks 42 are below the PCB 2. When this happens, the connector 12 makes contact with the PCB 2 causing the latch attachment leg 130 to flex downwardly, as at 132 in FIG. 24. When the inward pressure on the levers 38 are released and the downward pressure on the latches 16 is released, the latch attachment leg 130 tries to return to its quiescent state, as at 134, pulling the latch hooks 42 against the PCB 2 on the z-axis 17, as in FIG. 25.

Thus it has been shown and described a connector assembly for attaching cables to planar electrical devices. Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A connector assembly for electrically connecting one or more cables to a planar electrical device, the assembly comprising:

(a) a connector having a flat connector face and a Z axis perpendicular to the connector face;

(b) a pair of latches pivotally mounted to the connector, each latch having an arm with an end that extends beyond the connector face, the ends being biased toward each other to a closed position and being pivotable away from each other to an open position;

(c) a hook at the arm end and having a hook face that is offset from the arm and aligned with the connector face when the latches are in the closed position; and (d) a bias mechanism for biasing the hook faces and the connector face together on the Z axis;

(e) whereby, when the assembly is connected to the planar electrical device, the bias mechanism forces the hook faces and the connector face together with the planar electrical device therebetween.

2. The connector assembly of claim 1 wherein the hook faces are generally parallel to the connector face when the latches are in the closed position.

3. The connector assembly of claim 1 wherein the latch pivots on a hub, the arm extends from the hub, and a lever extends from the hub in generally the opposite direction from the arm.

4. The connector assembly of claim 1 wherein the connector is mounted in a shroud and the latches are mounted to the shroud.

5. The connector assembly of claim 4 wherein the bias mechanism includes one or more springs within the shroud biasing the connector face out of the shroud.

6. The connector assembly of claim 1 wherein the latches provide the bias mechanism.

* * * * *